US007839361B2

(12) United States Patent
Lee

(10) Patent No.: US 7,839,361 B2
(45) Date of Patent: Nov. 23, 2010

(54) METHOD OF DRIVING ORGANIC LIGHT EMITTING DISPLAY

(75) Inventor: Jae-Sung Lee, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 811 days.

(21) Appl. No.: 11/294,706

(22) Filed: Dec. 5, 2005

(65) Prior Publication Data

US 2006/0244691 A1 Nov. 2, 2006

(30) Foreign Application Priority Data

Apr. 29, 2005 (KR) ..... 10-2005-0036418

(51) Int. Cl.
*G09G 3/30* (2006.01)

(52) U.S. Cl. ..... 345/76; 315/169.3

(58) Field of Classification Search ..... 345/76–83; 315/169.3

See application file for complete search history.

(56) References Cited

U.S. PATENT DOCUMENTS

| | | | | |
|---|---|---|---|---|
| 6,054,981 | A * | 4/2000 | Kimoto et al. | 345/211 |
| 6,603,469 | B1 * | 8/2003 | Gettemy et al. | 345/211 |
| 6,661,398 | B2 * | 12/2003 | Iwasaki | 345/82 |
| 6,839,043 | B2 * | 1/2005 | Nakajima | 345/87 |
| 7,012,588 | B2 * | 3/2006 | Siwinski | 345/83 |
| 7,038,641 | B2 * | 5/2006 | Hirota et al. | 345/83 |
| 7,295,197 | B2 * | 11/2007 | Abe et al. | 345/211 |
| 7,310,092 | B2 * | 12/2007 | Imamura | 345/204 |
| 2002/0180723 | A1 * | 12/2002 | Siwinski | 345/212 |
| 2003/0098828 | A1 * | 5/2003 | Hunter et al. | 345/76 |
| 2003/0156074 | A1 * | 8/2003 | Ranganathan et al. | 345/1.1 |
| 2004/0108998 | A1 * | 6/2004 | Imamura | 345/204 |
| 2004/0178973 | A1 * | 9/2004 | Miller et al. | 345/82 |
| 2004/0222951 | A1 * | 11/2004 | Lee et al. | 345/77 |
| 2005/0052446 | A1 * | 3/2005 | Plut | 345/211 |
| 2005/0057562 | A1 * | 3/2005 | Cowan et al. | 345/419 |
| 2005/0110717 | A1 * | 5/2005 | Iwamura | 345/76 |
| 2005/0253835 | A1 * | 11/2005 | Kawase | 345/207 |
| 2005/0289363 | A1 * | 12/2005 | Tsirkel et al. | 713/300 |
| 2006/0001613 | A1 * | 1/2006 | Routley et al. | 345/76 |

(Continued)

FOREIGN PATENT DOCUMENTS

JP 2001-343936 12/2001

(Continued)

OTHER PUBLICATIONS

Korean Patent Abstracts, Publication No. 1020050000012 A, dated Jan. 3, 2005, in the name of Kyoung Moon Lim.

(Continued)

*Primary Examiner*—Alexander Eisen
*Assistant Examiner*—Nelson Lam
(74) *Attorney, Agent, or Firm*—Christie, Parker & Hale, LLP

(57) ABSTRACT

A method of driving an organic light emitting display is provided in which, during a standby mode, a display operation is performed using only eight colors. In the alternative, the luminance of a plurality of pixels is reduced by adjusting a duty ratio of the emission control signals. By reducing the luminance, power consumption and image sticking are reduced, and the life span of the pixels is increased.

9 Claims, 6 Drawing Sheets

U.S. PATENT DOCUMENTS

| | | | | |
|---|---|---|---|---|
| 2006/0132060 | A1* | 6/2006 | Chen | 315/291 |
| 2006/0132474 | A1* | 6/2006 | Lam | 345/204 |

FOREIGN PATENT DOCUMENTS

| | | |
|---|---|---|
| JP | 2002-040536 | 2/2002 |
| JP | 2002-169509 | 6/2002 |
| KR | 1999-0032289 | 5/1999 |
| KR | 2001-0105538 | 11/2001 |
| KR | 2003-0050970 | 6/2003 |
| KR | 2003-0056351 | 7/2003 |
| KR | 10-2005-000012 | 1/2005 |

OTHER PUBLICATIONS

Patent Abstracts of Japan and Korean Patent Abstracts previously filed on Jan. 11, 2007.

Patent Abstracts of Japan, Publication No. 2001-343936; Publication Date Dec. 14, 2001; in the name of Iwasaki.

Patent Abstracts of Japan, Publication No. 2002-040536; Publication Date Feb. 6, 2002; in the name of Shimada, et al.

Patent Abstracts of Japan, Publication No. 2002-169509; Publication Date Jun. 14, 2002; in the name of Furumiya.

Korean Patent Abstracts, Publication No. 1020030050970A; Publication Date Jun. 25, 2003; in the name of Son, et al.

Korean Patent Abstracts, Publication No. 1020030056351A; Publication Date Jul. 4, 2003; in the name of Lee, et al.

* cited by examiner

METHOD OF DRIVING ORGANIC LIGHT EMITTING DISPLAY

CROSS-REFERENCE TO RELATED APPLICATION

This application claims priority to and the benefit of Korean Patent Application No. 2005-36418, filed on Apr. 29, 2005, the entire content of which is incorporated herein by reference.

BACKGROUND OF THE INVENTION

1. Field of the Invention

The present invention relates to a method of driving an organic light emitting display and, more particularly, to a method of driving an organic light emitting display which adjusts luminance during a standby mode by restricting a plurality of pixels to 8 colors.

2. Description of Related Art

Organic light emitting displays have been used in cellular phones, digital cameras, home electronics, and similar devices as an alternative to a liquid crystal display (LCD) because of their fast response time, high contrast ratio, wide viewing angle, and low power consumption. Further, organic light emitting displays attract attention as the next generation flat panel display due to their excellent luminance and wide viewing angle.

However, the conventional organic light emitting displays have certain disadvantages that are discussed below. In the conventional art, brightness is adjusted by adjusting a voltage applied to an organic light emitting diode of the organic light emitting display during a standby mode. Adjusting the applied voltage also reduces power consumption.

Examples of this conventional method of adjusting the brightness may be found in the publications that follow. Korean Publication No. 2003-56351 discloses "APPARATUS AND METHOD OF DRIVING ELECTRO LUMINESCENCE PANEL" which adjusts luminance by changing a data voltage in the organic light emitting display. Korean Publication No. 2001-105538 discloses "BRIGHTNESS CONTROL METHOD FOR LCD" which adjusts luminance by determining whether an LCD is switched to an idle mode or not. Korean Publication No. 2003-50970 discloses that a controller of a mobile communication terminal determines an idle state to display a power save mode. Japanese Publication No. 2002-169509 discloses "METHOD FOR DRIVING FLAT DISPLAY PANEL AND METHOD FOR DRIVING ORGANIC ELECTRO-LUMINESCENCE DISPLAY PANEL" which adjusts the luminance in a standby mode of the organic light emitting display. Japanese Publication No. 2002-40536 discloses "METHOD FOR CONTROLLING POWER SOURCE FOR CAMERA" which determines a standby state of a camera to reduce power consumption. Finally, Japanese Publication No. 2001-343936 discloses "DISPLAY DEVICE, IMAGE FORMING DEVICE, RECORDING MEDIUM, PROGRAM AND LIGHT EMITTING DOIDE DRIVING METHOD" which reduces a time width of a driving signal of a driver to reduce power consumption.

The conventional methods of driving the organic light emitting display have the disadvantage of displaying the image in full color even during a standby mode. As a result, image sticking occurs and life span is reduced due to high power consumption and degradation.

SUMMARY OF THE INVENTION

The present invention, therefore, provides a method of driving an organic light emitting display which adjusts luminance by restricting a plurality of pixels to 8 colors or increasing a duty ratio of the emission control signals.

In an exemplary embodiment of the present invention, a method of driving an organic light emitting display having a plurality of data lines for transmitting data signals, a plurality of scan lines for transmitting scan signals, a plurality of emission control lines for transmitting emission control signals, and a plurality of pixels, includes: receiving the data signal such that the plurality of pixels are displayed in a normal mode; determining whether the plurality of pixels receive an operation signal within a first reference time or not; and switching to a standby mode in which the plurality of pixels are displayed in restricted colors or a duty ratio of the emission control signal is adjusted to reduce luminance, when the operation signal is not received within the first reference time.

In an exemplary embodiment of the present invention, a method of driving an organic light emitting display having a plurality of data lines for transmitting data signals, a plurality of scan lines for transmitting scan signals, a plurality of emission control lines for transmitting emission control signals, and a plurality of pixels, includes: receiving the data signal such that the plurality of pixels are displayed in a normal mode; determining whether the plurality of pixels receive an operation signal within a first reference time or not; switching to a standby mode in which the plurality of pixels are displayed in a restricted group of 8 colors when the operation signal is not received within the first reference time; determining whether the plurality of pixels receive the operation signal within a second reference time or not; and turning off the plurality of pixels when the plurality of pixels do not receive the operation signal within the second reference time.

DETAILED DESCRIPTION

Figure 1A:
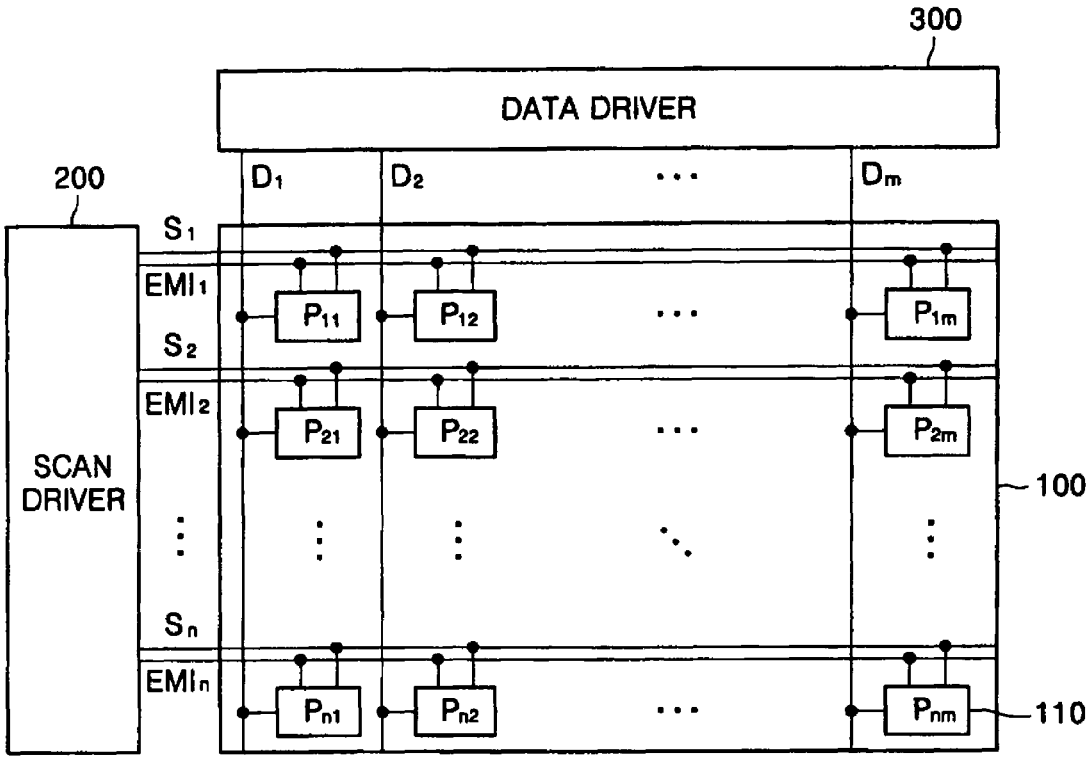
FIG. 1A is a schematic diagram of an organic light emitting display according to an exemplary embodiment of the present invention.

FIG. 1A is a schematic diagram of an organic light emitting display according to an exemplary embodiment of the present invention. The organic light emitting display includes a display panel 100, a scan driver 200 and a data driver 300.

The display panel 100 includes a plurality of data lines D1 to Dm arranged in a first direction, a plurality of scan lines S1 to Sn arranged in a second direction transverse to the first direction, a plurality of emission control lines EMI1 to EMIn arranged in the second direction, and a plurality of pixels 110 that include pixel circuits P11 to Pnm. Each pixel 110 is formed in a pixel region which is defined by an intersection of the plurality of data lines D1 to Dm, the plurality of scan lines S1 to Sn, and the plurality of emission control lines EMI1 to EMIn.

The scan driver 200 is coupled to the plurality of scan lines S1 to Sn and the plurality of emission control lines EMI1 to EMIn. The scan driver 200 applies scan signals for sequentially selecting the plurality of pixels 110 that include pixel circuits P11 to Pnm and emission control-signals EMI1 to EMIn for controlling an emission time.

The data driver 300 is coupled to the plurality of data lines D1 to Dm to apply a data signal to the pixel 110 selected by the scan signal of the scan driver 200. As a result, a driving current corresponding to the data signal is generated and applied to the pixel 110 causing this circuit to emit light.

Figure 1B:
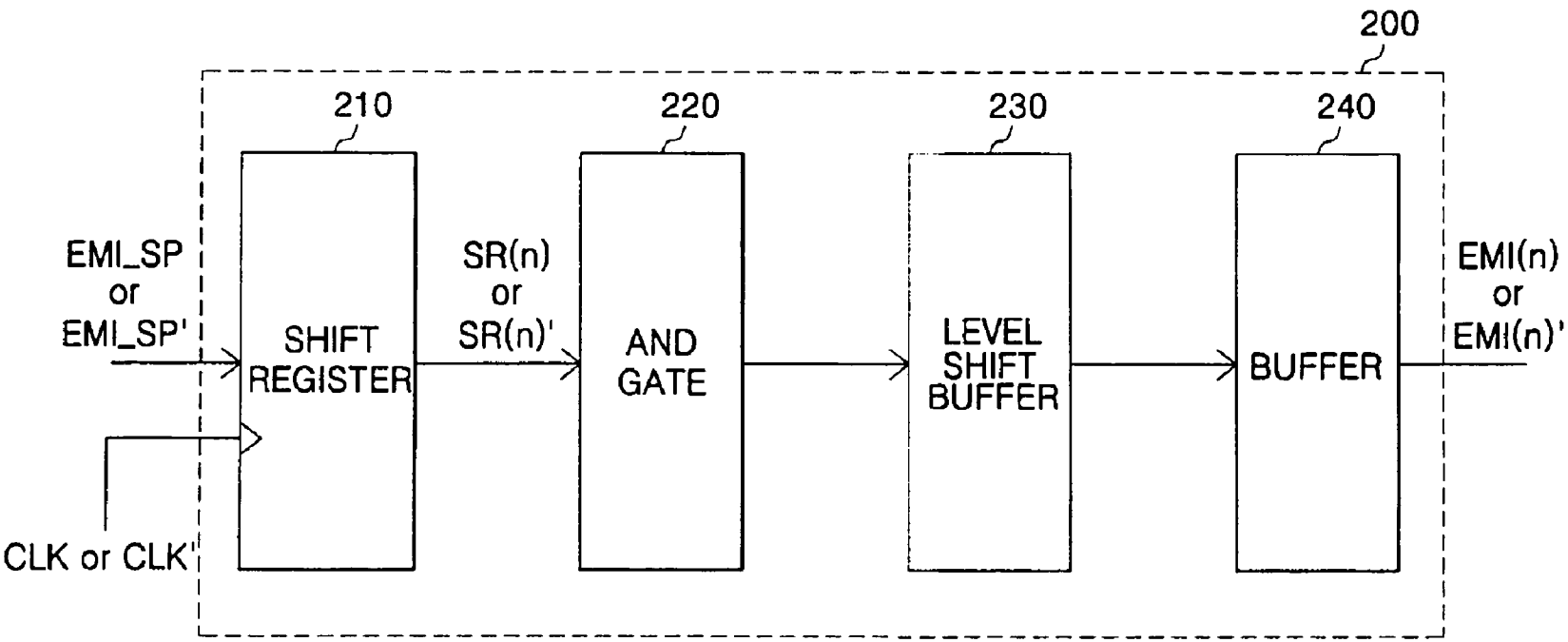
FIG. 1B is a block diagram of a scan driver of the organic light emitting display of FIG. 1A.

FIG. 1B is a block diagram of the scan driver 200 of the organic light emitting display of FIG. 1A. The scan driver 200 includes a shift register 210, an AND gate 220, a level shift buffer 230, and a buffer 240.

The organic light emitting display device of the present invention may operate during a normal mode or a standby mode. During a normal mode, typically the image produced by the organic light emitting display is changing and the organic light emitting display requires its full range of available colors to produce the image. During the standby mode, some parts of the image may not be changing as rapidly. Non-varying images may lead to color-sticking or unnecessary power consumption.

During the normal mode when the organic light emitting display is capable of displaying an image in full color, the emission control signal EMI(n) generated by the scan driver 200 controls a plurality of the pixels arranged in the organic light emitting display. The scan driver 200 receives an initial emission control signal EMP_SP and a clock signal CLK through the shift register 210 to transfer the emission control signal EMI(n) to the plurality of pixels.

After receiving the initial emission control signal EMI_SP and the clock signal CLK, the shift register 210 generates a shift register signal SR(n). Next, every two consecutive shift register signals SR(n) are sequentially ANDed by the AND gate 220. The AND gate 220 takes each two consecutive shift register signals, for example SR(i) and SR(i+1), and performs an AND operation to produce the emission control signals EMI(i). The outputs by the AND gate 220, that have a signal waveform of a certain level, go through the level shift buffer 230 that adjusts the level of the signal waveforms. Next, the buffer 240 creates a time delay between the arriving signals, thereby generating the emission control signals EMI(n).

During the standby mode, the organic light emitting display uses only 8 colors to display an image. In this mode, an emission control signal EMI(n)' generated by the scan driver 200 is converted to a level 9% to 11% lower than the lowest level of the emission control signal EMI(n) and is used to control the pixels 110. The scan driver 200 receives an initial emission control signal EMP_SP' and a clock signal CLK' through the shift register 210 to transfer the emission control signal EMI(n)' to the plurality of pixels 110.

After the shift register 210 receives the initial emission control signal EMI_SP' and the clock signal CLK', it generates a shift register signal SR(n)'. Each pair of successive shift register signals SR(n)' are ANDed together by the AND gate 220. The resulting signal goes through the level shift buffer 230, for adjusting its level, and through the buffer 240, for introducing a time delay between signals, thereby generating the emission control signal EMI(n)' of the standby mode.

Figure 1C:
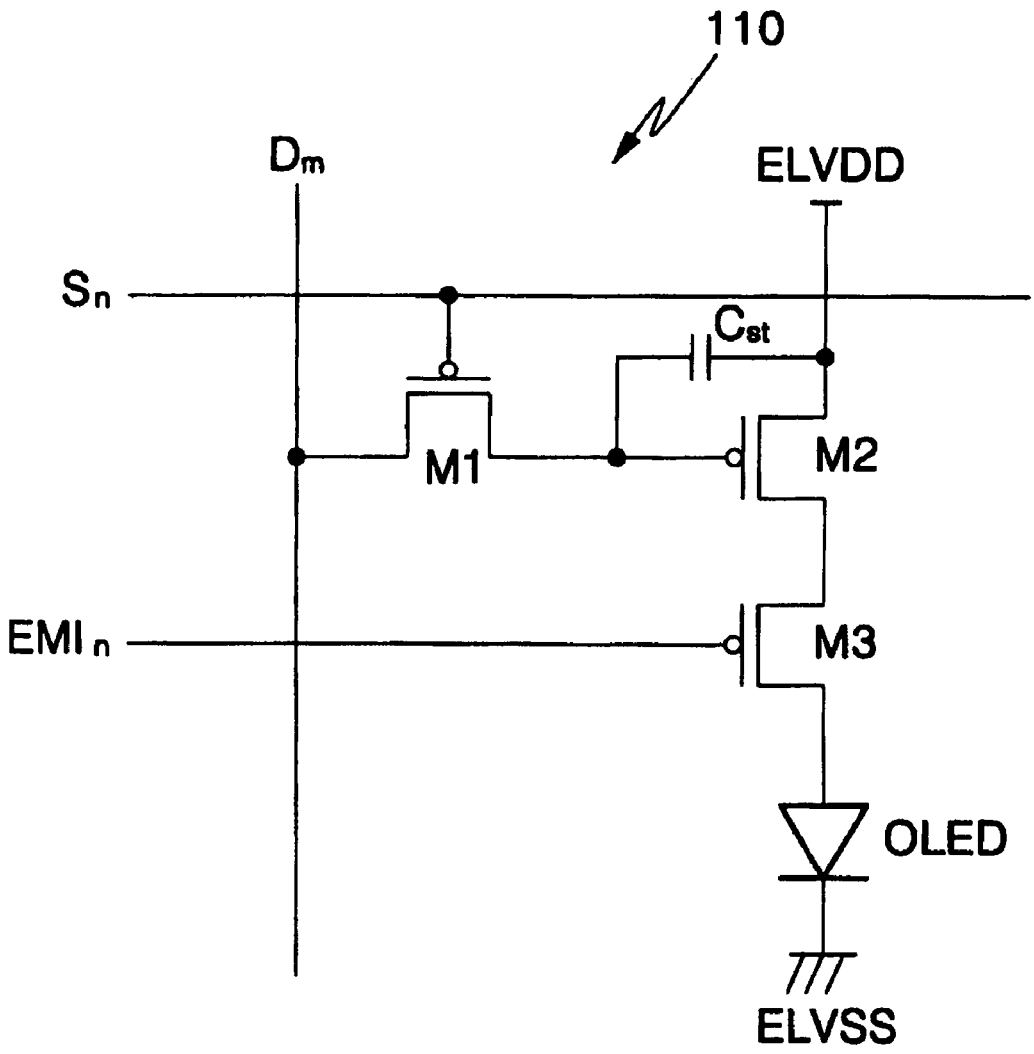
FIG. 1C is a circuit diagram illustrating one pixel of the organic light emitting display of FIG. 1A.

FIG. 1C is a circuit diagram of each pixel 110 of the organic light emitting display of FIG. 1A. The circuit of pixel 110 includes a switching transistor M1, a capacitor Cst, a driving transistor M2, an emission control transistor M3, and an organic light emitting diode OLED.

The switching transistor M1 is coupled to a data line Dm and transfers a data signal supplied from the data line Dm in response to a scan signal applied from a scan line Sn.

The capacitor Cst is coupled between the switching transistor M1 and a voltage supply source ELVDD and periodically stores the data signal transferred from the switching transistor M1 during one frame.

The driving transistor M2 is coupled to the capacitor Cst and the switching transistor M1 and generates a driving current corresponding to the data signal stored in the capacitor Cst. The gate of the driving transistor M2 is coupled to a drain of the switching transistor in the exemplary embodiment shown.

The emission control transistor M3 is coupled between the driving transistor M2 and the organic light emitting diode OLED and performs on/off operation according to an emission control signal transferred from the emission control line EMIn coupled to its gate. The emission control transistor M3 adjusts a level status value of the emission control signal to control the driving current corresponding to the data signal transferred from the driving transistor M2.

The emission control transistor M3 adjusts a level status value of the emission control signal to control an emission time of the organic light emitting diode OLED.

The organic light emitting diode OLED is coupled between the emission control transistor M3 and a ground voltage ELVSS and emits light at a luminance corresponding to the driving current generated from the driving transistor M2. The ground voltage ELVSS is a voltage lower than the voltage of the voltage supply source ELVDD and may even provide a negative voltage for receiving the driving current which passes through the organic light emitting diode OLED.

In the exemplary embodiment shown in FIG. 1C, all of the switching transistor M1, the driving transistor M2, and the emission control transistor M3 of the pixel 110 are p-type metal-oxide semiconductor field effect transistors (MOSFET), while in other embodiments n-type MOSFET transistors may be used.

Figure 2:
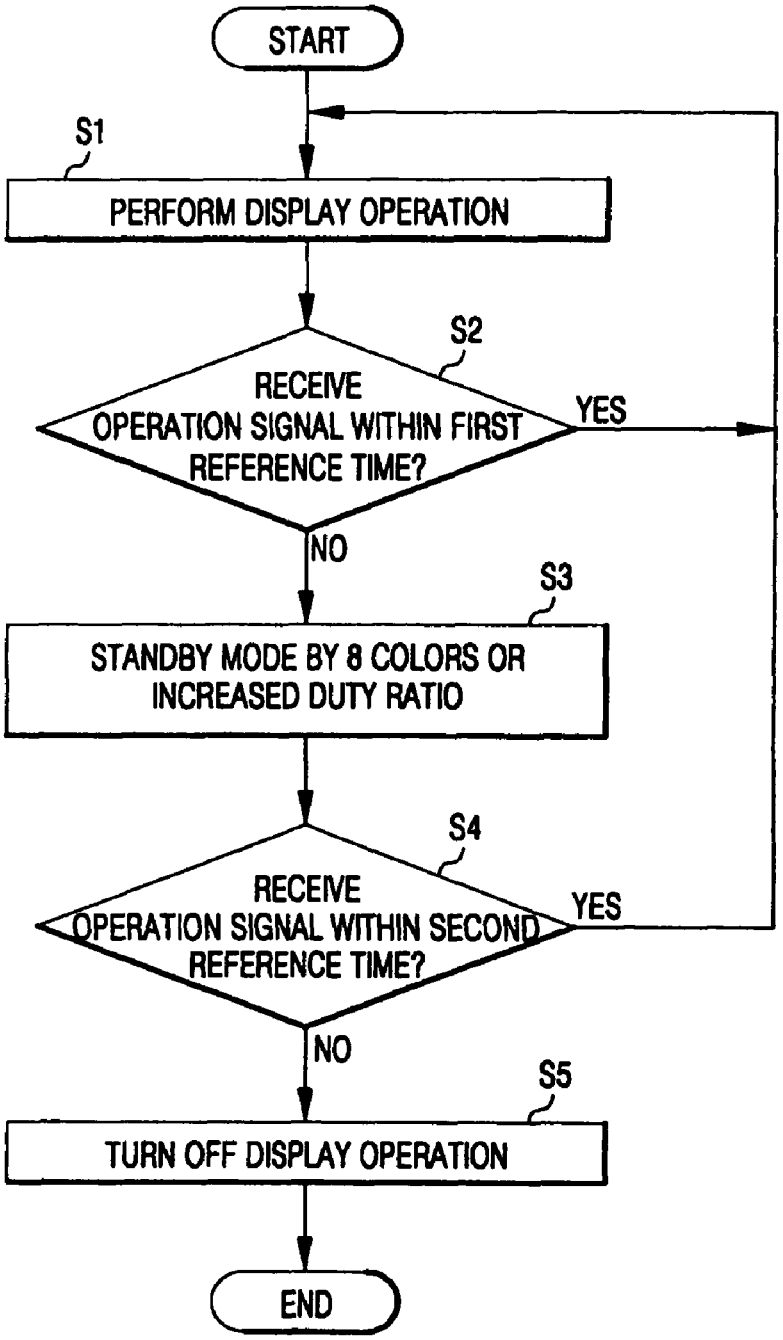
FIG. 2 is a flow diagram illustrating a method of driving an organic light emitting display according to an exemplary embodiment of the present invention.

FIG. 2 is a flow diagram illustrating a method of driving an organic light emitting display according to an exemplary embodiment of the present invention. During the normal mode, shown as step S1, the pixels operate such that all of the information received by each pixel is displayed on a display screen in full color. In this mode, a plurality of pixels of the organic light emitting display receive a data signal through a plurality of data lines, a scan signal through a plurality of scan lines and an emission control signal through a plurality of emission control lines. The pixels are also supplied with a voltage for power and emit light at their organic light emitting diode OLED.

If the pixels do not receive an operation signal for operating the organic light emitting diode OLED within a first reference time, the pixels maintain an awake state in which they do not perform any operations and remain turned on during the first reference time.

However, if the pixels receive the operation signal within the first reference time, the pixels perform a normal display operation in full color (step S2). The first reference time is a period selected from among a plurality of prescribed time durations. For example, the first reference time can be set as 10 seconds, 20 seconds, one minute, 30 minutes, one hour, or 12 hours.

Subsequently, if the pixels do not receive the operation signal even after exceeding the first reference time, the pixels go to a standby mode which restricts the pixels to 8 colors.

That is, if the pixels do not receive the operation signal even after the first reference time has lapsed, the pixels emit light in 8 colors which may be restricted to black, red, green, blue, a mixed color of red and green, a mixed color of green and blue, a mixed color of red and blue, and white. In the alternative, a duty ratio of the emission control signal is adjusted to reduce luminance. At this time, the pixels are displaying the images in 8 colors, and all display information is restricted to the 8 colors to be displayed on a display screen. In the alternative, the image information is displayed with a reduced luminance (step S3).

As a result, the pixels do not emit light in full color in the standby mode but are restricted to 8 colors to adjust luminance. Alternatively, the duty ratio is increased for adjusting luminance. Increasing the duty ratio of emission control signals increases the high signal duration which corresponds to an OFF period for PMOS transistors shown in the exemplary embodiment of FIG. IC. In the case that NMOS transistors are used as the emission control transistor M3 of the circuit of pixel 110, then a low signal is required to keep them off and the duty ratio of the emission control signals must be adjusted by reducing the duty ratio. Keeping the emission control transistor M3 off reduces luminance. By reducing luminance, power consumption, heat generation, and life span are improved.

However, if the pixels which are displaying images in 8 colors continuously receive the operation signal after exceeding the first reference time, the pixels revert to the normal mode and perform their normal operation which displays images in full color.

If the pixels which are displaying images in 8 colors or with an increased duty ratio do not receive the operation signal generated from the organic light emitting display within a second reference time, the pixels maintain the standby mode having an 8-color grayscale or an increased duty ratio. In this situation, the pixels are in an awake state in which they stay turned on but do not perform their normal full scale operation. However, if the pixels which are displaying images in 8 colors or with an increased duty ratio receive the operation signal within the second reference time, the pixels perform their normal operation which is displaying images in full color (step S4).

The second reference time is selected from among a plurality of prescribed time modes. For example, the second reference time can be 10 seconds, 20 seconds, one minute, 30 minutes, one hour, or 12 hours.

If the pixels do not receive the operation signal even after exceeding the second reference time, power is cut from the pixels and the display operation is stopped. That is, if the pixels do not receive the operation signal even though the second reference time has lapsed, the organic light emitting display cuts off the voltage supply source to turn off the display operations of the pixels (step S5).

The method of driving the organic light emitting display according to the present invention is explained below with reference to the timing diagrams of FIGS. 3A and 3B. A plurality of pixels receive a data signal through a plurality of data lines, a scan signal through a plurality of scan lines, and an emission control signal through a plurality of emission control lines. Thus, the pixels are displayed by receiving the data signal depending on control of the emission control signal and the scan signal.

Figure 3A:
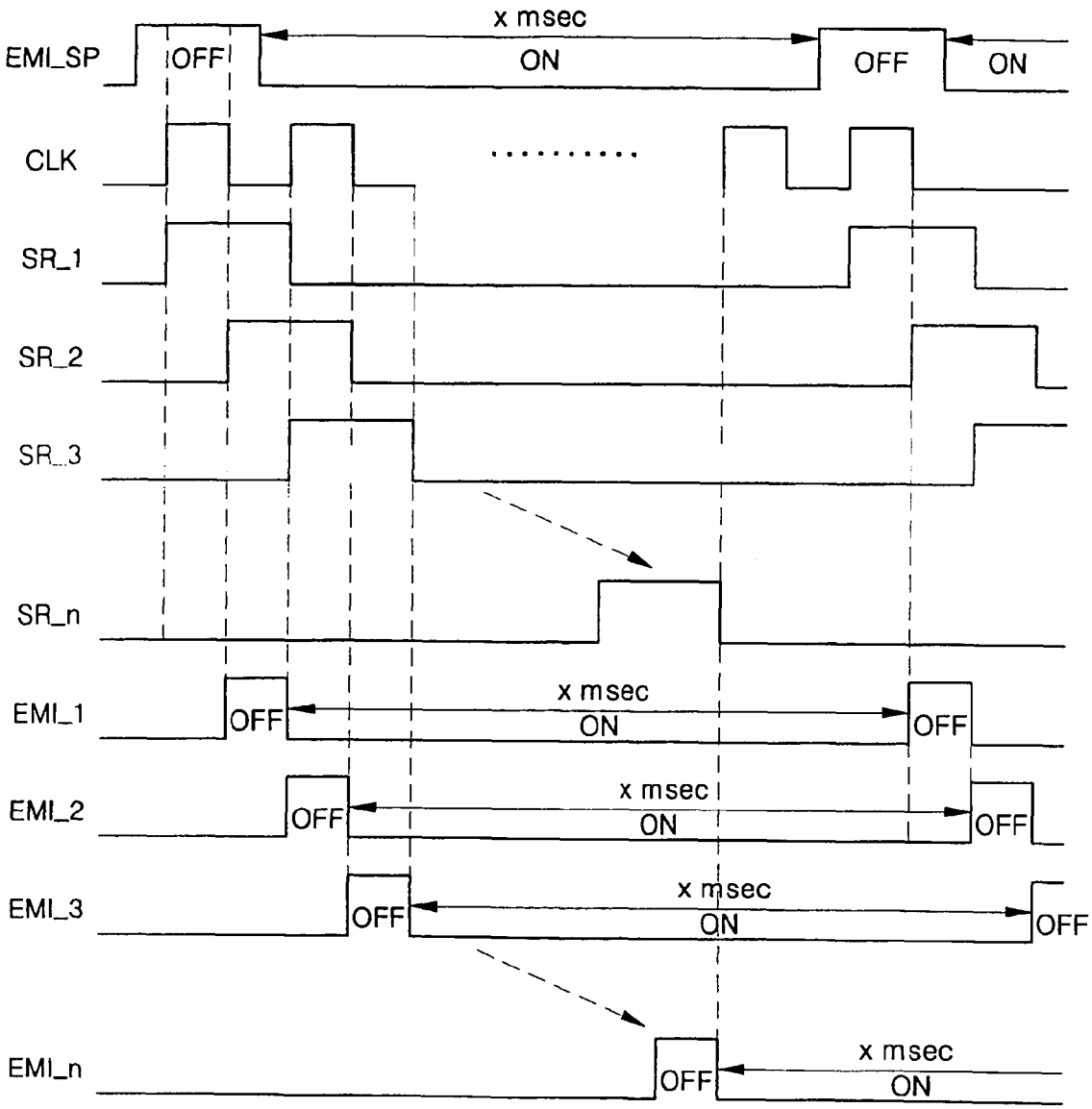
FIG. 3A is a timing diagram illustrating a method of driving the organic light emitting display in a normal mode according to an exemplary embodiment of the present invention.

FIG. 3A is a timing diagram illustrating a method of driving the organic light emitting display in the normal mode according to an exemplary embodiment of the present invention. The normal mode timing diagram represents a timing status in which the pixels receive the emission control signals EMI_1 to EMI_n to normally perform the display operation involving the full range of colors available to them.

The normal mode timing diagram generates a clock signal clk which is a basic trigger signal periodically applied to operate the organic light emitting display. The scan driver 200 mounted on the organic light emitting display has the shift register 210 which receives the initial emission control signal EMI_SP. The shift register 210 receives the initial emission control signal EMI_SP to sequentially generate $1_{st}$ to $n_{th}$ shift register signals SR_1 to SR_n.

The AND gate 220 of the scan driver 200 receives the shift register signals SR_1 to SR_n generated by the shift register 210, and ANDs each two consecutive signals of the shift register signals SR_1 to SR_n to generate emission control signals EMI_1 to EMI_n for controlling self-emission of a plurality of pixels 110. The pixels 110 receive the emission control signals EMI_1 to EMI_n, and the emission control signals EMI_1 to EMI_n control the pixels 110.

In more detail, the initial emission control signal EMI_SP has a low level during a time of x msec. As seen in FIG. 1 C, a low emission control signal turns on the emission control transistor M3 and allows a driving current to flow to the organic light emitting diode OLED. As a result, the pixels 110 can be displayed during the time x msec. The emission control signals EMI_1 to EMI_n are synthesized by the AND gate 220 from the shift register signals SR_1 to SR_n that are generated by the shift register 210 receiving the initial emission control signal EMI_SP. The emission control signals EMI_1 to EMI_n have a low level during an emission time x msec which is a portion of one frame during which the pixels 110 emit light. The pixels 110 are controlled by the emission control signals EMI_1 to EMI_n to display during the time× msec.

Figure 3B:
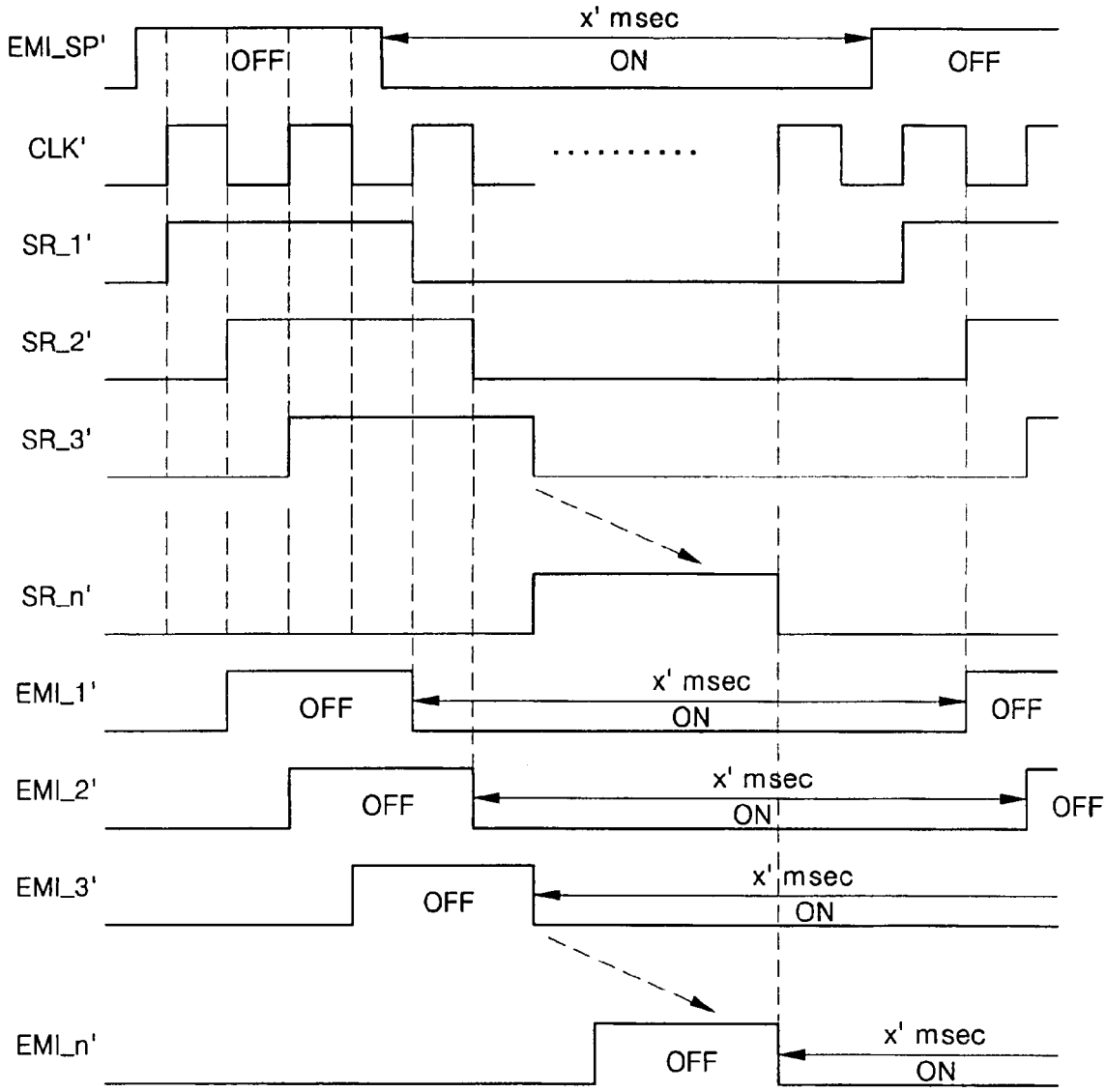
FIG. 3B is a timing diagram illustrating a method of driving the organic light emitting display in a standby mode according to an exemplary embodiment of the present invention.

FIG. 3B is a timing diagram illustrating a method of driving the organic light emitting display in a standby mode according to an exemplary embodiment of the present invention. The standby mode timing diagram represents a timing status in which a plurality of pixels are emitting light with a reduced luminance because the duration of time when the emission control signals EMI_1' to EMI_n' stay low is shortened.

The standby mode timing diagram generates a clock signal clk' which is a basic trigger signal periodically applied to operate the organic light emitting display. The scan driver 200 mounted on the organic light emitting display includes the shift register 210. The shift register 210 receives the initial emission control signal EMI_SP'. The shift register 210 sequentially generates $1_{st}$ to $n_{th}$ shift register signals SR_1' to SR_n' based on the initial emission control signal EMI_SP' received.

The AND gate 220 of the scan driver 200 receives shift register signals SR_1' to SR_n' generated by the shift register, and sequentially ANDs the shift register signals SR_1 to SR_n' to generate emission control signals EMI_1' to EMI_n' for controlling self-emission of the pixels 110. For example, the emission control signal EMI_1' is the result of performing an AND operation on the two consecutive shift register signals SR_1 and SR_2 and the emission control signal EMI_2 is the AND result of shift register signals SR_2 and SR_3 and is on only if both of these signals are on and is off otherwise.

The pixels 110 receive the emission control signals EMI_1' to EMI_n', that control the on or off status of emission control transistor M3 in the pixels 110.

The initial emission control signal EMI_SP' has a low level during an emission time x' msec. In the exemplary embodiment shown in FIG. 1C for the circuits of pixels 110 the emission control transistor M3 is shown as a PMOS transistor that turns on when a low emission control signal is applied to its gate. So, the pixel 110 can emit light and display an image during the time x' msec. The emission control signals EMI_1' to EML_n' are generated from the shift register signals SR_1' to SR_n' by the AND gate 220. The shift register signals SR_1' to SR_n' are in turn generated by the shift register 210 receiving the initial emission control signal EMI_SP'. The emission control signals EMI_1' to EMI_n' have a low level during the emission time x' msec which is a portion of one frame during which the pixels 110 emit light. The pixels 110 are controlled by the emission control signals EMI_1' to EMI_n' to emit light and display an image during the time x' msec.

A comparison of the standby mode timing diagram of FIG. 3B with the normal mode timing diagram of FIG. 3A follows.

The low level periods of the emission control signals, when the pixels 110 of the exemplary embodiment of FIG. 1 C are on, are shown as "ON" on FIGS. 3A and 3B. The ON or low level periods of the emission control signals EMI_1' to EMI_n' for the standby mode of FIG. 3B are shorter in duration than the ON or low level periods of the emission control signals EMI_1 to EMI_n generated in the normal mode of FIG. 3A. With the shorter ON periods of the standby mode, the pixels 110 are switched to the standby mode during which the display operation is performed in 8 colors or the duty ratio of the emission control signal is increased to reduce luminance.

The emission control signals EMI_1' to EMI_n' generated in the standby mode of FIG. 3B have their ON or low level, during which the pixels 110 can emit light and display an image, during the time x' msec. The emission control signals EMI_1 to EM1_n generated in the normal mode of FIG. 3A have their ON or low level, during which the pixels 110 may emit light and display an image, during a time x msec. In the embodiment shown in FIGS. 3A and 3B, the emission time x' msec of the standby mode is only 90% of the emission time x msec of the normal mode. This difference between the durations of the two emission times x' msec and x msec may be varied in different embodiments. Further, if NMOS transistors are used in a variation on the circuit of the pixel 110, then high level values of the emission control signals would correspond to the ON periods.

In the standby mode, because the ON values of the emission control signals EMI_1' to EML_n' generated in the standby mode are shorter in duration than the ON values of the emission control signals EMI_1 to EMIn generated in the normal mode, brightness of the pixels is adjusted and lowered during the standby mode. If the pixels 110 enter the standby mode, they will become restricted to 8 colors or will have , for example, a 10%-reduced luminance due to the duty ratio which is increased compared to the duty ratio of the normal mode.

As described above, the method of driving the organic light emitting display according to the present invention restricts the pixels to 8 colors or increases the duty ratio to adjust the luminance, thereby reducing power consumption, preventing the degradation that causes image sticking, and improving the life span of the pixels.

Although the present invention has been described with reference to certain exemplary embodiments, it will be understood by those skilled in the art that a variety of modifications and variations may be made to the present invention without departing from the spirit or scope of the invention defined in the appended claims, and their equivalents.

What is claimed is:

1. A method of driving an organic light emitting display, the organic light emitting display having a plurality of data lines for transmitting data signals, a plurality of scan lines for transmitting scan signals, a plurality of emission control lines for transmitting emission control signals, and a plurality of pixels, the method comprising:

receiving the data signals that enable the plurality of pixels to operate in a normal mode;

shifting an initial emission control signal to generate a plurality of shift register signals;

generating the emission control signals by performing logical AND operation on consecutive ones of the shift register signals;

determining whether or not the plurality of pixels is receiving an operation signal within a first reference time;

switching to a standby mode if the operation signal is not received within the first reference time; and after switching to the standby mode, determining whether or not the plurality of pixels receives the operation signal within a second reference time; and turning off the plurality of pixels if the plurality of pixels does not receive the operation signal within the second reference time, wherein during the normal mode a display operation by the plurality of pixels is performed in full color, and during the standby mode, a duty ratio of the emission control signals is adjusted to reduce pixel luminance.

2. The method of claim 1, wherein during the standby mode the duty ratio of the emission control signals increases such that the plurality of pixels has a reduced luminance compared to their luminance during the normal mode.

3. The method of claim 1, wherein if the plurality of pixels receives the operation signal within the first reference time, the plurality of pixels returns to the normal mode.

4. The method of claim 1, wherein if the plurality of pixels receives the operation signal within the second reference time, the plurality of pixels returns to the normal mode.

5. A method of driving an organic light emitting display having a plurality of data lines for transmitting data signals, a plurality of scan lines for transmitting scan signals, a plurality of emission control lines for transmitting emission control signals, and a plurality of pixels, the method comprising:

shifting an initial emission control signal to generate a plurality of shift register signals; and generating the emission control signals by performing logical AND operation on consecutive ones of the shift register signals;

receiving the data signals such that the plurality of pixels performs a display operation in a normal mode;

determining whether or not the plurality of pixels receives an operation signal within a first reference time;

switching to a standby mode if the operation signal is not received within the first reference time;

determining whether or not the plurality of pixels receives the operation signal within a second reference time; and turning off the plurality of pixels when the plurality of pixels does not receive the operation signal within the second reference time, wherein during the standby mode, a duty ratio of the emission control signals is adjusted to reduce pixel luminance.

6. The method of claim 5, wherein during the standby mode, the plurality of pixels performs the display operation in a restricted group consisting of eight colors.

7. The method of claim 1, wherein during the standby mode, the display operation is performed in restricted colors.

8. The method of claim 7, wherein, the display operation during the standby mode is performed in eight colors.

9. The method of claim 8, wherein the eight colors include black, red, green, blue, a mixed color of red and green, a mixed color of green and blue, a mixed color of red and blue, and white.

* * * * *